US011346196B2

(12) United States Patent
Saltykov et al.

(10) Patent No.: US 11,346,196 B2
(45) Date of Patent: May 31, 2022

(54) METHOD AND APPARATUS FOR COMPLEX ACTION FOR EXTRACTING HEAVY CRUDE OIL AND BITUMENS USING WAVE TECHNOLOGIES

(71) Applicant: ILMASONIC-SCIENCE LIMITED LIABILITY COMPANY, Moscow (RU)

(72) Inventors: Alexander Alexeevich Saltykov, Shchyolkovo (RU); Yuriy Alexeevich Saltykov, Moscow (RU); Anatoly Antonovich Olshevskiy, Shchyolkovo (RU)

(73) Assignee: ILMASONIC-SCIENCE LIMITED LIABILITY COMPANY, Moscow (RU)

( * ) Notice: Subject to any disclaimer, the term of this patent is extended or adjusted under 35 U.S.C. 154(b) by 0 days.

(21) Appl. No.: 16/961,938

(22) PCT Filed: Oct. 4, 2018

(86) PCT No.: PCT/RU2018/000654
§ 371 (c)(1),
(2) Date: Jul. 14, 2020

(87) PCT Pub. No.: WO2020/060435
PCT Pub. Date: Mar. 26, 2020

(65) Prior Publication Data

US 2020/0340339 A1 Oct. 29, 2020

(30) Foreign Application Priority Data

Sep. 21, 2018 (RU) ..... 2018133511

(51) Int. Cl.
*E21B 28/00* (2006.01)
*E21B 43/24* (2006.01)
*E21B 43/26* (2006.01)

(52) U.S. Cl.
CPC ..... *E21B 43/2401* (2013.01); *E21B 28/00* (2013.01); *E21B 43/2408* (2013.01); *E21B 43/26* (2013.01)

(58) Field of Classification Search
CPC ..... E21B 41/0085; E21B 36/00; E21B 36/04; E21B 36/006; E21B 28/00; E21B 43/2401; E21B 43/2405
See application file for complete search history.

(56) References Cited

U.S. PATENT DOCUMENTS 3,994,340 A 11/1976 Anderson et al.
4,037,658 A 7/1977 Anderson
(Continued)

FOREIGN PATENT DOCUMENTS

CA 1108081 9/1981
CA 2700135 3/2009
(Continued)

OTHER PUBLICATIONS

Nikolin I. V. "Methods of Development of Heavy Oils and Natural Bitumens", Science the Foundation for Solving Technological Problems of Russia's Development, 2007, No. 2, 16 pages.
(Continued)

*Primary Examiner* — Kenneth L Thompson
(74) *Attorney, Agent, or Firm* — Nixon & Vanderhye PC

(57) ABSTRACT

The invention relates to the field of oil production, in particular, to a method for extracting high-viscosity, heavy oil or bitumen. The equipment package includes a ground frequency generator combined with a power and control unit and 2 downhole instruments. One downhole device is an
(Continued)

electrohydraulic downhole device with a plasma discharger (hereinafter referred to as DEHDPD) of directional action, designed to create microcracks in the oil reservoir. The second well device has a long length (up to 50 meters) and consists of alternately alternating microwave and acoustic emitters (hereinafter DDMWAE), which simultaneously or alternately affect the oil reservoir. Downhole devices are lowered into the well, their movement along the horizontal well and power supply to them is carried out using a umbilical cable. Oil production from the well is carried out using a pump fixed between the umbilical cable and the DDMWAE. The use of the invention makes it possible to increase the efficiency and environmental friendliness of extraction of high-viscosity, heavy oil or bitumen from a horizontal well due to the complex application of acoustic and electromagnetic wave technologies.

20 Claims, 8 Drawing Sheets

(56) References Cited

U.S. PATENT DOCUMENTS

| | | | | |
|---|---|---|---|---|
| 4,535,845 | A | 8/1985 | Brown et al. | |
| 4,597,443 | A | 7/1986 | Shu et al. | |
| 4,696,345 | A | 9/1987 | Hsueh | |
| 4,874,043 | A | 10/1989 | Joseph et al. | |
| 8,771,503 | B2 | 7/2014 | Cha et al. | |
| 8,789,772 | B2 * | 7/2014 | Moeny | E21B 7/15 241/1 |
| 10,641,073 | B2 * | 5/2020 | Curlett | E21B 43/20 |
| 2017/0204707 | A1 * | 7/2017 | Clark | E21B 28/00 |
| 2020/0399541 | A1 | 12/2020 | Pringle et al. | |

FOREIGN PATENT DOCUMENTS

| | | |
|---|---|---|
| RU | 2 098 615 | 12/1997 |
| RU | 2 206 728 | 6/2003 |
| RU | 2 213 858 | 10/2003 |
| RU | 2 223 398 | 2/2004 |
| RU | 2 225 942 | 3/2004 |
| RU | 2 379 489 | 1/2010 |
| RU | 2 382 933 | 2/2010 |
| RU | 2 454 532 | 6/2012 |
| RU | 2 456 441 | 7/2012 |
| RU | 2 478 778 | 4/2013 |
| RU | 131 062 U1 | 4/2013 |
| RU | 2 509 880 | 3/2014 |
| RU | 2 529 039 | 9/2014 |
| RU | 2 589 741 | 7/2016 |
| RU | 2 600 249 | 10/2016 |
| RU | 2 630 012 | 9/2017 |
| RU | 2 640 846 | 1/2018 |
| WO | 2011/001408 | 1/2011 |
| WO | 2011/145979 | 11/2011 |

OTHER PUBLICATIONS

Sidorov I. V. "Investigation of High-viscosity Oil Inflow Processes in Weakly Cemented Reservoirs", The dissertation on Competition of a Scientific Degree of Candidate of Technical Sciences, Tyumen State University, Tyumen, 2015, 137 pages.

Yutkin L. A Electrohydraulic Effect and its Application in Industry. L.: Mashinostroenie, Leningradskoe otd., 1986, 256 pages.

Kovaleva L., Davletbaev A, Minnigalimov R. "Recoveries of Heavy Oil and Bitumen Technologies with the Radio Frequency Electromagnetic Irradiation", Society of Petroleum Engineers (SPE) Moscow, Russia, Oct. 26-28, 2010, 12 pages.

Morozov G. A, Morozov O. G. Microwave Technologies for Oil and Gas Production Complex Materials of the 12th International Conference, "Microwave Equipment and Telecommunications Technologies Computer Vision-2002", Sevastopol, Sep. 2002, pp. 28-31.

Bientinesi et al., "A New Technique for Heavy Oil Recovery Based on Electromagnetic Heating: Pilot Scale Experimental Validation", Chemical Engineering Transactions, vol. 32, 2013, 6 pages.

Yi Pan et al., "Development of Radio Frequency Heating Technology for Shale Oil Extraction", Open Journal of Applied Sciences, Jun. 2012, vol. 2, No. 2, pp. 66-69.

ITU Publications: Radio Regulations, Edition of 2012, 435 pages.

Kuznetsov O. L., Simkin E. M., Chilingar J. Physical Bases of Vibration and Acoustic Effects on Oil and Gas Reservoirs, 2001, 260 p., 9 pages.

Revissky Yu. V., Dyblenko V. P. "Investigation and Justification of the Mechanism of Oil Recovery using Physical Methods", Moscow, Nedra, 2002, 300 p., 41 pages.

Malyukov V. P., Alibekov M. E. "Innovative Technologies for the Intensification of Oil Production from Heterogeneous Reservoirs in the Fields of Ultra-viscous Oils of Tatarstan", Vestnik RUDN, Engineering Research Series, 2015, No. 3, 9 pages.

G.R. Izmaylova et al., "Mathematical Modelling of Influence of Radio-Frequency Electromagnetic and Acoustic Fields on Oil Layer", Oil and Gas Business, Aug. 2014, No. 4, pp. 127-152.

K. Naderi et al., "Clarifications on Oil/Heavy Oil Recovery Under Ultrasonic Radiation Through Core and 2D Visualization Experiments", Journal of Canadian Petroleum Technology (JCPT), Nov. 2008, vol. 47, No. 11, pp. 56-62.

* cited by examiner

| Criteria | Dimension | Quantitative change | |
|---|---|---|---|
| | | The range of variation | Most likely values |
| Depth of occurrence | m | 61 – 1097.3 | 200 - 400 |
| Porosity | % | 15 - 40 | 30 - 40 |
| Permeability | mcm2 | 0.001 – 10.0 | 1.0 – 3.0 |
| Oil saturation at the beginning of steam injection | % | 35 - 90 | 55 - 75 |
| The viscosity of the reservoir oil | mPa*c | 10 - 100000 | 500 - 3000 |
| Reservoir temperature | °C | 15.5 – 137.8 | 20 - 50 |
| Oil density | Kg/m3 | 860 - 1018 | 970 - 1000 |

METHOD AND APPARATUS FOR COMPLEX ACTION FOR EXTRACTING HEAVY CRUDE OIL AND BITUMENS USING WAVE TECHNOLOGIES

This application is the U.S. national phase of International Application No. PCT/RU2018/000654 filed Oct. 4, 2018, which claims priority to Russian Application No. 2018133511 filed Sep. 21, 2018, the entire contents of each of which are hereby incorporated by reference.

FIELD OF THE INVENTION

The invention relates to the field of oil production, in particular, to a method for extracting high-viscosity, heavy oil or bitumen. This method is most effective for use in horizontal wells and fields with low-permeable formations, including shale.

BACKGROUND

Due to the decline in proven reserves of light and medium-sized oil, the oil and gas industry has been increasingly engaged in extracting hard-to-recover reserves of high-viscosity and/or heavy oils and bitumens in recent years. Various technologies are used for their extraction. The most widely used technology is steam-assisted gravity Drainage, which uses two horizontal wells located on top of each other. This technology is known worldwide as SAGD (Steam Assisted Gravity Drainage). It is developed and used for bitumen production in Canada, as well as Venezuela, Russia, the United States and several other countries.

In the classical scheme, this technology requires drilling two horizontal wells, located parallel to each other, through oil-saturated thicknesses near the bottom of the formation [1]. The upper horizontal well is used for injecting steam into the formation and creating a high-temperature steam chamber (FIG. 1). the process of steam-gravity action begins with the pre-heating stage, during which (2-3 months) steam circulation is produced in both wells. At the same time, due to the conductive heat transfer, the formation zone is heated between the producing and injection wells, the oil viscosity in this zone is reduced and, thus, the hydrodynamic connection between the wells is provided.

At the main stage of production, steam is already injected into the injection well. The injected steam, due to the difference in density, makes its way to the upper part of the productive reservoir, creating an increasing size of the steam chamber.

At the interface between the steam chamber and cold oil-saturated thicknesses, a constant process of heat exchange occurs, as a result of which the steam condenses into water and together with the heated oil flows down to the production well under the influence of gravity.

Industrial development of high-viscosity oil and natural bitumen deposits using SAGD technology is carried out in a fairly narrow range of geological and physical parameters. The table (FIG. 2) shows the quantitative values of the coolant injection criteria for successful projects in the world [2]. The author notes that the vast majority of successful projects in the world (98%) are carried out in fields with a porosity of 25-40%.

Disadvantages of the Technology [3]:

- a significant part of the cost of oil production is associated with the cost of steam generation;
- requires a source of a large volume of water, as well as water treatment equipment with a large capacity;

- for effective application of the technology, a homogeneous layer of relatively high power is required;
- it is necessary to have clean continuous Sands to achieve a high level of production;
- the solution is not for all types of heavy oil;
- careful optimization is required.

But there are several key challenges that companies using SAGD technology must overcome in the first place to achieve profitability of the technology. This:

- achieving maximum energy efficiency;
- optimal oil and water separation process;
- water treatment for reuse in steam production.

One of the promising ways to improve the efficiency of SAGD projects from a technological, economic and, most importantly, from an environmental point of view is the use of hydrocarbon solvents. In recent years, a number of modifications to the SAGD have been developed:

Vapour Extraction—VAPEX)—extraction of oil by means of a vaporous solvent,

Expanding Solvent SAGD ( )—vapor-gravity effect with the addition of a solvent,

Solvent Aided Process (SAP)—process with added solvent,

Steam Alternating Solvent (SAS)—the alternating injection of steam and solvent

As well as other less well-known modifications. Despite the variety of technologies, they can be divided into 3 groups:

- technologies where steam is completely replaced with a solvent;
- combined steam and solvent injection;
- sequential (cyclic) injection of steam and solvent.

The need for modifications to SAGD is due to the desire to improve the economic performance of projects, take into account the specific geological and physical conditions of the field, as well as strict requirements in the field of environmental protection. SAGD projects are the largest consumers of fresh water in the production regions, and the payment for greenhouse gas emissions from steam production may become a significant cost item in the foreseeable future.

There are many known methods for extracting high-viscosity, heavy oils and bitumens [4-17] and others. All these methods are feasible either with the use of a large number of wells, or with the use of a large number of chemicals, or with the use of a large number of additional equipment. All this leads to large financial and labor costs, increased time and materials. An important aspect is the environmental hazard of these methods.

The method of developing deposits of viscous oils and bitumens is the closest in technical essence and achieved result to the method proposed by the authors [4]. Offered in patent method of development of deposits of viscous oil and bitumen includes the construction of a production well with a horizontal exposed area of a productive formation, construction of injection wells with horizontal uncovered the plot located over the same area producing well in the same reservoir at a distance of not less than 4 m, pumping of heat carrier to injection well and the selection of product formation from the production well, monitoring the temperature of the produced well production and flow rate from the production well, when each reduction in flow rate or when the temperature of the formation product to 90% of the temperature break of heat carrier from injection well to producing mining insulation equal portions sequentially from the bottom of injection wells, followed by the operation of oil wells in normal mode. Moreover, the horizontal section injection wells are built to meet the horizontal portion of the production well, an injection well is divided into sections with a pitch of 20-50 m, the injection of coolant to produce each plot sequentially, starting from the bottom and their subsequent isolation by maintaining distance, excluding breakthrough coolant in the previous section. After pumping the coolant into the last section of the injection well, the coolant is injected along the entire length of the injection well in a volume approximately equal to the total volume of injection into all sections.

This method has a number of disadvantages. The main disadvantages of this method are the complexity and cost in the construction of horizontal injection wells, the possibility of breakthrough of the displacing agent to the well bore, large time and energy costs of producing the water vapor, their secondary treatment and injection into the well, the complexity and awkwardness of the equipment for a stepwise isolation of injection wells. This method is also difficult to apply for deposits with insufficient reservoir thickness. In addition, this method is low-environmental.

The disadvantages of the technology in steam assisted gravity drainage: a significant portion of the cost of oil production related to the cost of steam; requires a source of a large volume of water, and equipment for the preparation of water having a large bandwidth for effective use of technology requires a uniform layer of comparatively high power.

SUMMARY OF THE INVENTION

The technical result of the claimed invention group is to increase the efficiency and environmental friendliness of extracting high-viscosity and/or heavy oil and bitumen from wells through the integrated application of acoustic and electromagnetic wave technologies.

The stated technical result is achieved due to a method for extracting highly viscous oil, heavy oil or bitumen from a formation, comprising: selecting parameters of electro-hydraulic, microwave and plasma exposure individually for each well; pretreating a horizontal well by an electrohydraulic device with a directional plasma discharger to create microfractures in the formation; placing on a permanent basis in a horizontal well a downhole device having alternating microwave and acoustic emitters configured for heating the formation, said downhole device is connected to a ground power supply and control through an umbilical cable; treating the formation by microwaves and acoustic waves using the downhole device while moving the downhole device along the horizontal well back and forth; extracting oil or bitumen from the formation by means of a pump and the umbilical cable after heating the formation to a temperature of 60-80° C.; terminating treatment of the formation by microwaves and acoustic waves when the temperature reaches 120-130° C.

In a particular case of implementation of the claimed technical solution, low-frequency electrohydraulic action of a horizontal well is performed at a frequency of 0.01-1.0 Hz and is carried out by pulses of 0.5-5.0 kJ.

In a particular case of implementation of the claimed technical solution, microwave exposure is carried out at frequencies of 0.915, 2.5 or 5.8 GHz.

In a particular case of implementation of the technical solution of the acoustic impact on the formation is carried out by periodic exposure to the field of elastic fluctuations of ultrasonic range in a continuous mode and a pulsed low frequency acoustic effects, and in continuous mode the exposure is carried out by high frequency oscillation ultrasonic range 10 to 30 kHz and in a pulsed mode, the exposure is carried out with frequency 1-10 Hz.

In a particular case of implementation of the declared technical solution, the formation is heated in sections of 50 meters.

In a particular case of implementation of the declared technical solution, an additional horizontal well is drilled above the first one at the roof of the formation and the solvent is injected into it.

In a particular case, the declared technical solution is implemented for the production of high-viscosity and/or heavy oil from vertical or horizontal wells, or from shale deposits.

The technical result is also achieved due to a device for extracting highly viscous oil, heavy oil or bitumen from a formation, comprising a ground power supply and control unit located on a surface, and configured for alternating connection through an umbilical cable with an electrohydraulic downhole device with a directional plasma discharger that is configured to create microfractures in the formation only in lateral and upper directions, and with a downhole device that comprises the following modules: a cable head, a guide head, at least one transformer unit, and at least one microwave and at least one acoustic emitter located in series.

In another particular case of implementation of the claimed technical solution, the device is configured so that the plasma discharger is made with a mechanical wire feed drive, wherein a body of the plasma discharger is screwed onto a connecting sleeve, and a support sleeve is attached to a lower part to the body of the discharger, and a wire feeder is installed in the middle part of the sleeve, consisting of a wire spool, a cylinder, a piston connected by means of a rod to a driving pinion drive stage that transmits rotation to a wire feed pinion, and wherein the piston is made with holes for equalizing pressure in an over-piston space with the pressure in a well, and wherein an anode and the cathode are fixed in the support sleeve, the cathode is made with an axial hole for wire passage, and a guide cone with a reflector configured to provide directional radiation is fixed from below to the support sleeve with the help of supports.

In another particular case of implementation of the claimed technical solution, in the housing of of the acoustic emitter and perpendicular to its axis, acoustic transducers are located made as piezoplates, which are placed in the housing perpendicular to each other and there is a support ring between them with an electrical insulating coating to prevent electrical shorting of piezoplates, wherein each piezoplate consists of longitudinally polarized, electrically connected piezoceramic rings with intervening pads located between them, providing high-frequency electrical energy supply to piezoceramic rings, while an emitter housing is made with a wavy surface that provides its transverse pliability, which allows to obtain a single oscillatory circuit that includes the acoustic transducers and the housing.

In another particular case of implementation of the claimed technical solution, the device is configured so that the microwave emitter consists of a waveguide, a magnetron and a heat exchanger, and the waveguide is made with four conically shaped funnels that provide microwave radiation emission in the radial direction, and the heat exchanger is made of a plate type and has a cross section view of a multi-pointed star.

In a particular case of implementation of the claimed technical solution, the microwave emitter is configured to adjust power in the range of 0.4-0.6 kW.

In a particular case of implementation of the claimed technical solution, the downhole electrohydraulic device is configured to adjust power in the range of 0.5 to 5 kJ.

In a particular case of implementation of the claimed technical solution, the downhole electrohydraulic device is designed with the possibility of low-frequency impact from 0.01 to 1.0 Hz.

In a particular case of implementation of the claimed technical solution, the microwave emitter is designed with the ability to emit at frequencies of 0.915, 2.5 or 5.8 GHz.

In a particular case of implementation of the claimed technical solution, the acoustic emitter is designed to operate in a constant mode at frequencies of 10-30 kHz and in a pulse mode at frequencies of 1-10 Hz.

In another particular case of implementation of the claimed technical solution, a flexible connection of the downhole device modules of the microwave and acoustic emitters is made in a form of two connecting support sleeves, each of which is attached on one side to the connected modules, and on another side the connecting support sleeves are interconnected by at least two flexible cables, and made with axial holes, where electrical wires are laid, wherein said connection is filled with a silicone filling that is flush with an outside contour of the downhole device.

In a particular case of implementation of the claimed technical solution, a coiled tubing containing electrical wires is used to connect the power supply and control unit with downhole devices.

In a particular case of implementation of the claimed technical solution, the downhole devices are made with a diameter of 80 mm.

In a particular case of implementation of the claimed technical solution, the downhole devices are made with a diameter of 100 mm.

In a particular case of implementation of the claimed technical solution, temperature sensors are integrated into the guide head and cable head of the downhole device for microwave and acoustic emitters.

In a particular case of implementation of the claimed technical solution, the downhole device of microwave and acoustic emitters is made up to 50 meters long.

In a particular case of implementation of the claimed technical solution, an electrohydraulic device with a plasma discharger is made in the form of a block structure, with replaceable blocks of capacitors for regulating the discharge power.

BRIEF DESCRIPTION OF THE DRAWINGS

Details, features, and advantages of this utility model follow from the following description of options for implementing the claimed technical solution using drawings that show:

Figures 1, 2:
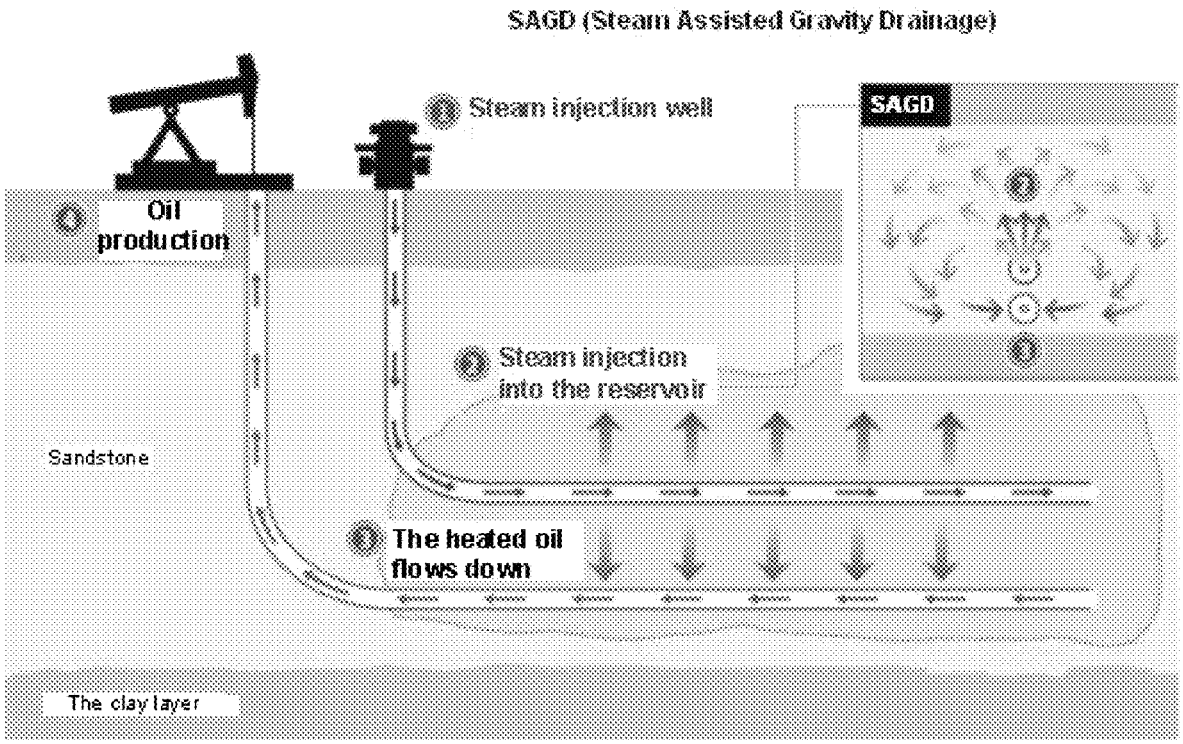
FIG. 1—scheme of steam-gravity drainage (SAGD)
FIG. 2—quantitative values of the coolant injection criteria for successful projects in the world.

The figures indicate the following positions by numbers: 1—plasma discharger; 2—capacitor module; 3—transformer module; 4—cable head; 5—guide cone; 6—anode; 7—guide cone support; 8—cathode; 9—support sleeve; 10—cylinder; 11—piston; 12—wire; 13—rod; 14—wire feed pinion; 15—drive pinion; 16—yoke; 17—coil with wire; 18—spark gap housing; 19—ring; 20—reflector; 21—guide head; 22—acoustic emitter; 23—microwave emitter; 24—flexible connection; 25—transformer block; 26—DDMWAE cable head; 27—cover plate; 28—piezoceramic; 29—contact pad; 30—bolted connection; 31—acoustic radiator housing; 32—support sleeve; 33—screed; 34—support ring; 36—waveguide; 37—magnetron; 38—heat exchanger; 39—silicone fill; 40—cable; 41—horizontal well; 42—DDMWAE; 43—pump; 44—umbilical cable feeder; 45—umbilical cable; 46—power supply and control unit; 47—logging lift; 48—pump and compressor pipe; 49—stranded cable; 50—climate container.

DETAILED DESCRIPTION OF THE INVENTION

Disclosed is a set of equipment that includes a ground frequency generator combined with a power supply and control unit and 2 downhole devices.

One downhole device is downhole electro-hydraulic device with a plasma discharger (hereinafter referred to as DEHDPD) of directional action, designed to create microcracks in the oil reservoir. The second well device has a long length (up to 50 meters or more) and consists of alternately alternating microwave and acoustic emitters (hereinafter DDMWAE), which simultaneously or alternately affect the oil reservoir. Downhole devices are lowered into the well, their movement along the horizontal well and power supply to them is carried out using a umbilical cable.

One horizontal well is drilled near the bottom of the oil reservoir in the same way as the SAGD technology described above. Oil production from the well is carried out using a screw pump fixed between the umbilical cable and the DDMWAE.

First, the DEHDPD descends into the well, performing a low-frequency (0.01-1.0 Hz) impact with powerful pulses (0.5-5.0 kJ) and creates a network of microcracks along the entire length of the well. Thanks to a special mechanism, cracks are created only in the upper and side directions.

Then DDMWAE is lowered into the well and microwave and acoustic influence on the formation is carried out. The DDMWAE is constantly moving back and forth along the length of the well to process the entire formation located above the well.

The use of microwave technology for oil reservoir heating is due to the fact that it has a number of advantages over traditional methods of heating substances:

higher heating speed, since the heat is immediately distributed throughout the entire volume, regardless of the thermal conductivity of the liquid;

selectivity of heating: the temperature of oil increases twice as much as the temperature of its constituent water and many times more than the temperature of solid rocks;

high environmental friendliness of heating due to the absence of combustion product;

excellent control of the heating process: the power of microwave radiation can be changed very quickly, so it is easy to automate this process;

high (up to 90%) efficiency of converting microwave energy into heat.

Electrohydraulic action (frequency 0.01-0.05 Hz) provides high and ultrahigh pulsed hydraulic pressures (up to 2-104 MPa), resulting in shock waves with sound and supersonic speeds [18]. Shock movements of the liquid that occur during the development and collapse of cavitation cavities can create microcracks in the formation, which can reach several tens or hundreds of meters in length.

Most of the materials that make up an oil reservoir—a productive oil-saturated reservoir, reservoir fluid, oil, and their components (resins, asphaltenes, paraffins, oil-water emulsions, bitumens, viscous and ultra-viscous hydrocarbons, etc.) are non-magnetic dielectric materials with weak electrical conductivity by their electromagnetic properties [19, 20]. When such substances interact with the electromagnetic field, electrohydrodynamic phenomena occur in the electromagnetic field. In such materials, electromagnetic fields penetrate deep enough: from fractions to several tens of meters. Numerous studies in different countries, in particular laboratory studies described in [21, 22], confirm the effectiveness of microwave exposure for heating both traditional oil reservoirs and shale.

Special attention should be paid to the choice of parameters for processing the oil reservoir by thermal and acoustic influence. It should be noted that the proposed technology provides for the permanent installation of DDMWAE in a horizontal well and its almost continuous operation until the resource is fully developed. In this regard, the parameters of the microwave emitter (hereinafter MWE) and acoustic emitter (hereinafter AE), the frequency and power of radiation, are selected individually for each well based on the thermal, electrophysical and other characteristics of the reservoir and oil, the thickness (power) of the reservoir, and so on.

Unfortunately, the choice of MWE frequencies for electromagnetic heating tasks is limited, according to the international radio regulations [23], only 3 frequencies can be used: 915 MHz, 2450 MHz and 5800 MHz.

Figure 3:
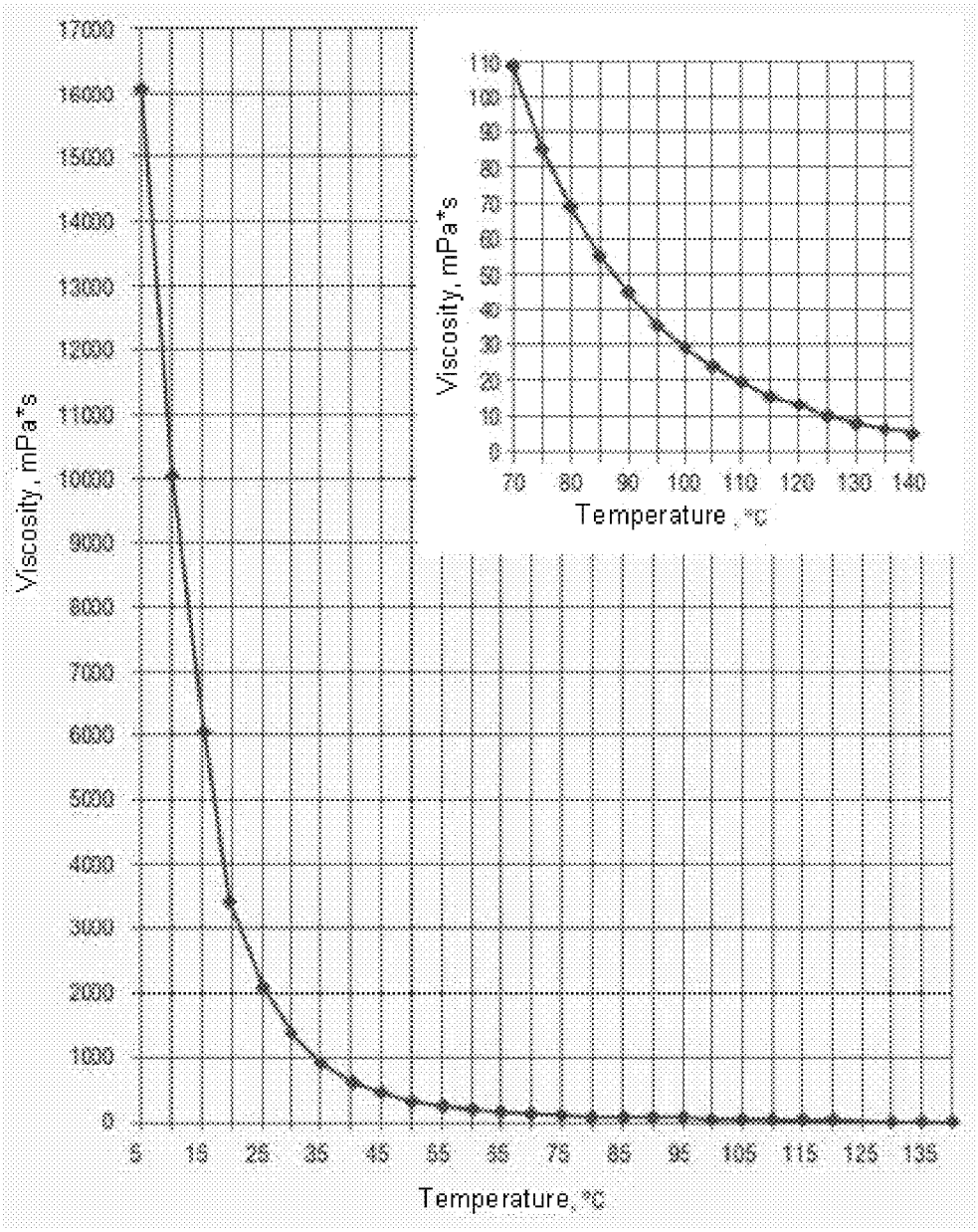
FIG. 3—graph of the dependence of the viscosity of heavy oil on temperature.

Choosing maximum heating temperature of the reservoir. In [24], it is shown that the viscosity of oil decreases intensively with increasing temperature (FIG. 3) and at a temperature level of 120-130° C. reaches the level of light oil (5-10 MPa·s). Therefore, the appropriate level of heating of heavy oil is a temperature of no more than 130° C.

Acoustic emitters can operate in both continuous and pulsed modes. In continuous operation, the most effective frequencies are those close to the ultrasonic range (10-30 kHz). This effect provides [25]:

breaking of intermolecular bonds;

capillary effect;

the destruction of plugging, asphaltene-resin-paraffin (paraffin) and mineral deposits.

When pulsed, low-frequency vibrations (1-10 Hz) affect mainly the boundary layers of the liquid with the solid phase, contributing to the destruction of the structure of the near-surface layers and reducing the coupling of the liquid with the solid phase [26,27].

Of particular interest is the combined effect of high-frequency electromagnetic and acoustic fields on saturated porous media, primarily due to the emergence of new cross-phenomena—the thermoacoustic effect [28]. In particular, the phenomenon of increasing the effective thermal conductivity of saturated porous bodies when combining conductive heating with the influence of sound frequency waves was established. This significantly increases the depth and intensity of reservoir heating.

In general, the proposed technology has the following advantages over existing technologies for extracting heavy and high-viscosity oils using horizontal wells:

has no restrictions on the minimum thickness of the formation;

there is no need for fresh water;

no need to clean water and separate oil from water;

there is no risk of steam or solvent escaping from the upper well to the lower well;

there is no need to wait several months for the formation to warm up, oil can be extracted from the well immediately as the oil warms up in the near zone.

Figure 4:
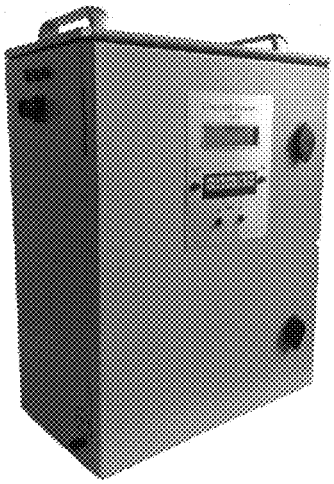
FIG. 4—power supply and control unit.
Figure 5:
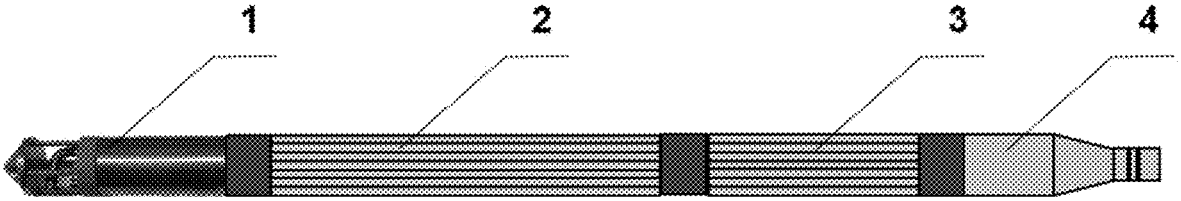
FIG. 5—electrohydraulic device with a plasma discharger.
Figure 6:
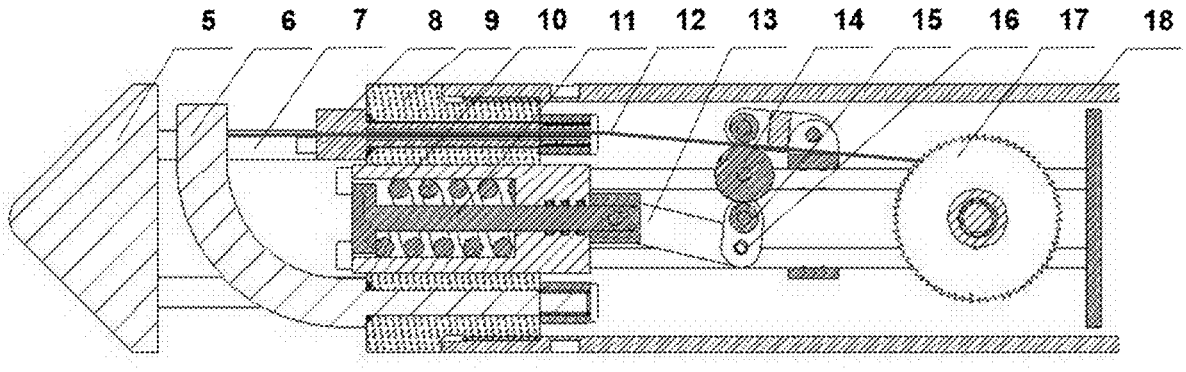
FIG. 6—plasma discharger.
Figure 8:
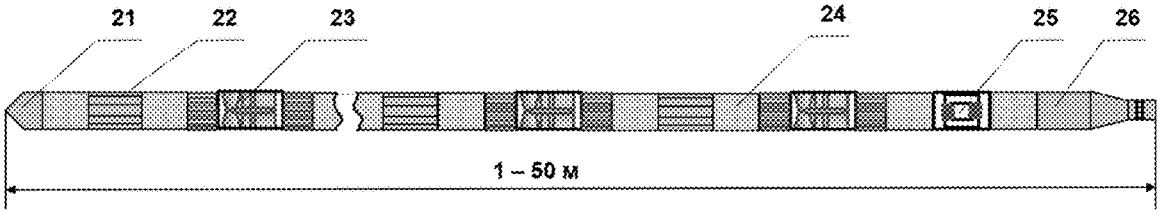
FIG. 8—downhole device for microwave and acoustic emitters.

The device to achieve the technical result is available on the surface of the power supply and control (FIG. 4) and an electro-hydraulic downhole tool with a plasma discharger (FIG. 5) and a downhole tool with microwave and acoustic emitters (FIG. 8).

Power supply and management (further-PSM) contains a known module that provides power supply DEHDPD and MWE, as well as a generator of acoustic frequency for AE. The PSM is connected to the DEHDPD and DDMWAE by means of a umbilical cable or coiled tubing containing electrical wires.

DEHDPD and DDMWAE can be manufactured with a diameter of 80 mm taking into account the selected power and design of modules.

The DEHDPD consists of the following main modules (FIG. 5): the plasma discharger module (1), the capacitor module (2), the transformer module (3) and the cable head (4).

In the transformer module (3), the supply voltage is converted to a constant high-voltage voltage. Due to the fact that the conversion of the input power supply voltage is performed at a high frequency, the step-up-decoupling transformer included in the transformer module has a small size.

The capacitor module (2) uses capacitors whose one output is a coaxial pin, and the second output is a cylindrical housing, so the capacitors are connected in parallel to the battery by simply attaching the pins. This design takes up a minimum of space and allows you to use small-sized components.

The plasma discharger is designed with a mechanical drive. It is made in the form of a block, easily disassembled design that allows you to easily replace any parts, as well as install a new coil with wire, which is especially important in the field. The spark gap housing (18) is screwed onto the connecting bushing (not shown in the drawing) and secured with a screw. In the lower part, a support sleeve (9) made of fiberglass is screwed to the body (18) of the spark gap, to which all other elements are attached.

In the middle part of the bushing, a cylinder (10) is screwed in, in which a piston (11) with a rod and spring is installed. Small holes are made in the piston (11) to equalize the pressure of the over-piston space with the pressure in the well.

Figure 7:
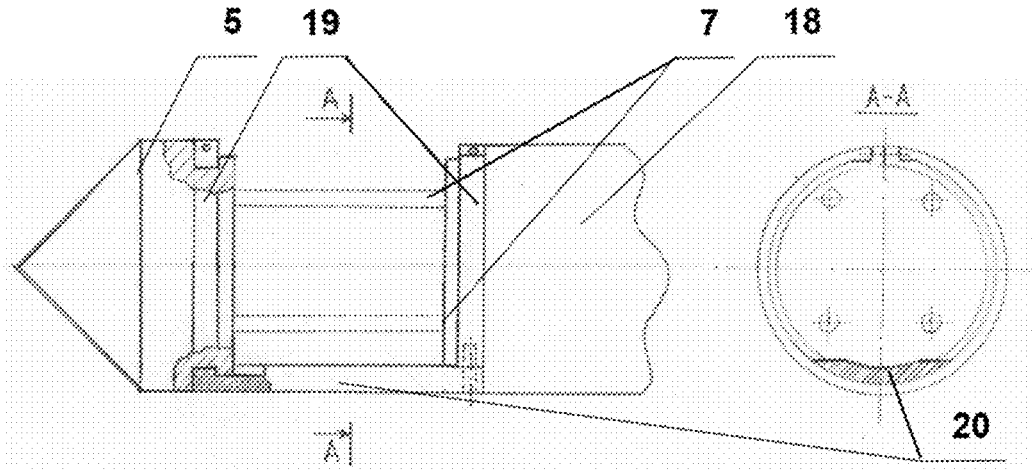
FIG. 7—the mechanism of directed action of the plasma discharger.

The anode (6) and cathode (8) are fixed in the support sleeve (9). In the cathode (8), an axial hole is made in the electrode for passing the wire (12). the guide cone (5) is attached to the support sleeve using the supports (7) of the guide cone. It provides free movement of the SEG along the tubing and simultaneously, together with the racks, protects the electrodes from mechanical impact. To organize a plasma discharge, an anode (6) and a cathode (8) are used, through which a wire (12) passes connecting these 2 electrodes. Inside the housing (18) is a wire feed mechanism consisting of a cylinder (10), a piston (11) connected by means of a rod (13) to the yoke (16) of the drive gear (15). The drive gear (15) transmits rotation to the wire feed gear (14), which feeds the wire (12) from the coil (17) to the cathode (8). For directed radiation in a plasma discharger, a directed action mechanism is used, which for better perception is shown in a separate figure (FIG. 7). on the guide cone (5) and the body of the discharger (18), two rings (19) are freely placed in the slots, to which a massive reflector (20) is attached. When the DEHDPD is moved along a horizontal well, the reflector (20) will move from any spatial position to the lower position by gravity. In this case, the waves from the electrohydraulic discharge will propagate only in the lateral and upper direction. Instead of rings (19), bearings can be used to increase the reliability of moving the reflector to the lower position. DEHDPD is constructed on a low-frequency (0.01 to 1.0 Hz) the impact of powerful pulses (0.5-5.0 kJ). Specific values are selected based on reservoir characteristics.

Figure 11:
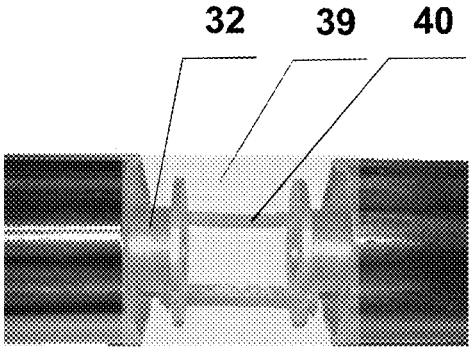
FIG. 11—flexible connection.

The DDMWAE consists of a guide head (21) and a cable head DDMWAE (25), between which acoustic emitters (22) and microwave emitters (23) are located sequentially one after the other. One step-up transformer block (25) is used for 2-3 microwave emitters. All the listed elements (modules) are connected to each other by flexible connections (24) (FIG. 11). Flexible connection of modules downhole complex is made of two connecting support sleeves (32), each of the sleeves attached on one side to connect the modules DDMWAE, and the other side of the connecting sleeve are connected by at least two flexible wires (40). The connecting sleeves are made with axial holes in which electric wires are laid, and the said connection is filled with silicone filling (39) flush with the external contour of the DDMWAE.

For the manufacture of a transformer block, an inverter circuit is used, which ensures the small size of the block and its high conversion efficiency. Temperature sensors are integrated into the guide head (21) and cable head of the DDMWAE (26) to control the heating of the borehole fluid.

Figure 9:
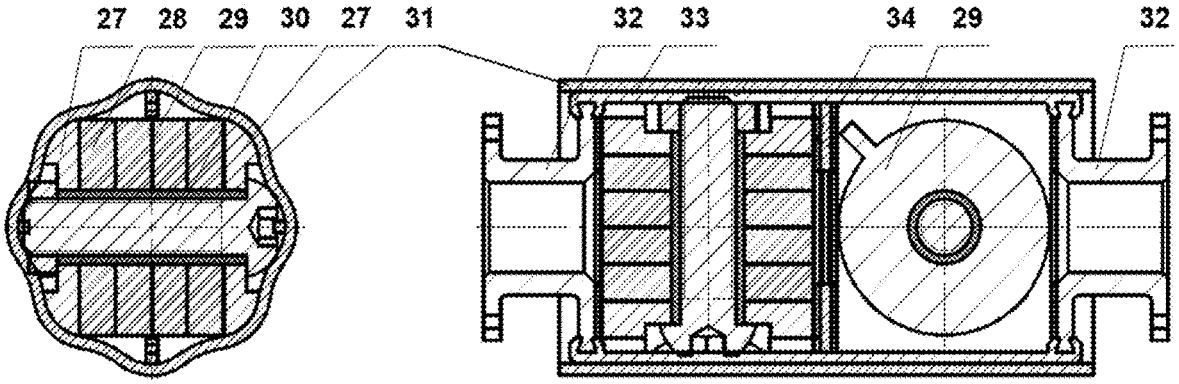
FIG. 9—acoustic emitter.

Acoustic transducers in the emitter (22) can be made of magnetostrictive or piezoceramic type (FIG. 9). Acoustic transducers made in the form of piezopackets. They are located in the radiator housing perpendicular to each other, which provides maximum acoustic power radiation in the radial direction. The radiator housing is made with a wavy surface formed by making grooves on the outer and inner surface of the housing (31), made, for example, by milling along the length of the housing. The undulating surface of the body provides its transverse pliability.

This housing design allows you to create a single oscillating circuit "acoustic converters-housing", which provides maximum radiation power in the radial direction and maximum uniformity of radiation. The piezo package consists of longitudinally polarized, electrically connected piezoceramic rings (28) with contact pads (29) located between them, providing high-frequency electrical energy supply to the piezoceramic rings. The piezo package is tightened using profiled linings (27) and a bolted connection (30).

Piezopackets are placed in the housing (FIG. 9, right part) between the support sleeve (32) and are secured by ties (33). The piezopackets are separated by a support ring (34), which, in addition to isolating the piezopackets, increases the strength of the housing against external static or dynamic pressure. The surfaces of the support bushings and the support ring that are in contact with the piezopackets are covered with an electrical insulation material to prevent the contact pads of different polarities from closing together.

This device provides independent operation of each piezo package placed in the housing (31). This is due to the mutual location of piezo packages. This design allows you to increase the selectivity of acoustic impact on the well, bottom-hole zone, formation.

When using a magnetostrictive transducer, it is also positioned perpendicular to the axis of the emitter housing (31) between the profiled plates (27).

AE operates at frequencies of 10-30 kHz and in pulse mode with a frequency of 1-10 Hz.

The emitter operates in two modes: constant and pulsed. In constant mode, the emitter operates at frequencies close to 20,000 Hz. These frequencies are affected by the effects of ultrasound:

- breaking of intermolecular bonds (destruction of stable bonds at the pore-fluid interface);
- capillary effect;
- the destruction of plugging, asphaltene-resin-paraffin deposits and mineral;
- changing the rheology of oil, approximation of its properties to the properties of the Newtonian fluid.

Due to these effects, the pores of the bottom-hole zone of the formation within a radius of about 3 meters and perforations are cleaned.

In pulse mode, the emitter operates at frequencies of about 1-10 Hz. In this mode, the wavelength is several tens of meters, depending on the propagation medium (for example, in water it is 15 meters). Its feature is a slight attenuation at long distances (more than 1000 meters). When the pulse operates high starting currents (up to 10 A) and there are emissions of powerful energy (about 20 kJ per hour), which allows the sound wave to spread over a distance of up to 1000 meters, slightly losing efficiency. This allows you to affect the entire area of the well supply and attract stagnant zones to work.

Figure 10:
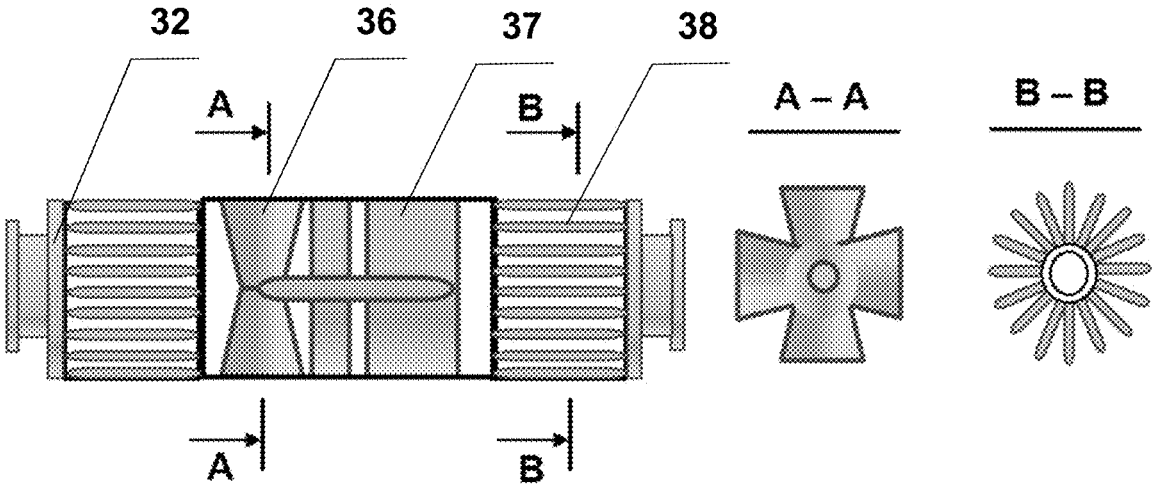
FIG. 10—microwave emitter.

The microwave emitter (FIG. 10) consists of a junction of the MWE with other elements in the form of a support sleeve (32), a waveguide (36), a magnetron (37) and a heat exchanger (38). The waveguide has 4 cone-shaped funnels that provide radiation of microwaves in the radial direction. A plate heat exchanger (38) made of a material with good thermal conductivity (for example, duralumin) is generally used to cool the magnetron and the inner cavity of the MWE. The heat exchanger (38) in the cross section is made in the form of a multi-pointed star. The MWE power is selected in the range of 0.4-0.6 kW in order to provide heat removal due to a plate refrigerator and reduce the dimensions of the supply transformer (25). the MWE is designed for the frequency allowed for microwave heaters of 0.915, 2.5 or 5.8 GHz. the Specific value is selected depending on the characteristics of the oil reservoir.

All elements (modules) DDMWAE are connected by a flexible connection (FIG. 11) consisting of a silicone fill (39) and flexible cables (40). The silicone filling ensures the compressive strength of the DDMWAE and the sealing of the modules, as well as the protection of the electrical wires that supply these modules. Cables provide the DDMWAE tensile strength. Flexible connection in General allows you to wind DDMWAE at its long length (up to 50 meters) on the drum, similar to an umbilical cable or coiled tubing. The length of the DDMWAE is selected based on the length of the horizontal well and the available electrical power at the well. Also, the length of the DDMWAE is limited by the electrical power of the supply cable and its own diameter, which limits the possibility of laying more powerful wires to power acoustic and microwave emitters.

The proposed method of extracting high-viscosity, heavy oil or bitumen involves the following operation of the device used.

Figure 12:
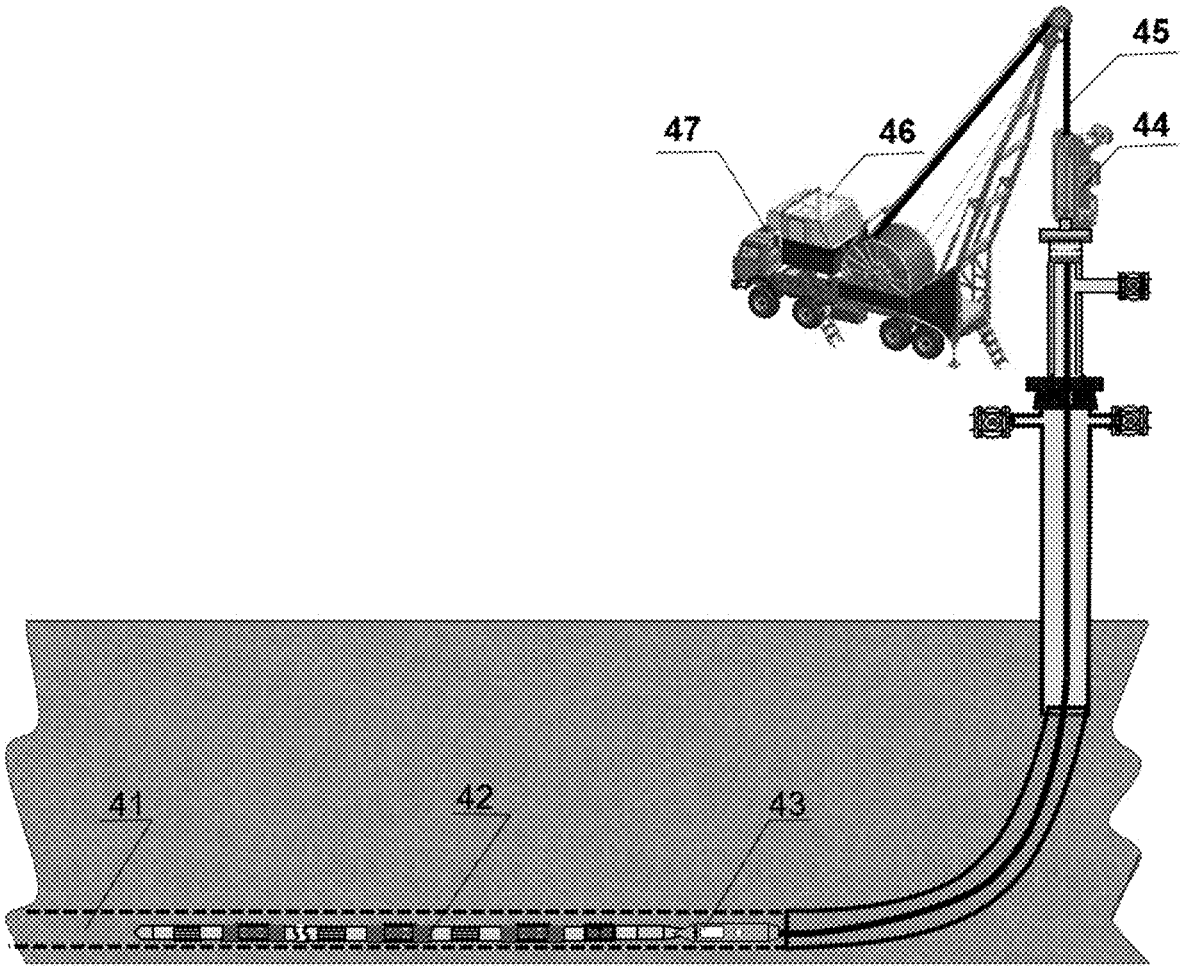
FIG. 12—layout diagram of equipment and equipment for the implementation of the proposed method of extracting heavy oil from a horizontal well.

A mobile or stationary logging station (47) with an umbilical cable (FIG. 12) is used for the descent of the DEHDPD and DDMWAE. The power and control unit (46) is placed in the cabin of the logging station (47) and connected to the umbilical cable (45), and the other end of the umbilical cable is alternately connected to the DEHDPD or DDMWAE (42). An injector (44) is used for lowering downhole devices and umbilical cable into a horizontal well (41) and moving along the well.

First, the DEHDPD is lowered into the well and produces a low-frequency impact with powerful pulses of 0.5-3.0 kJ with a frequency of 10-30 pulses per linear meter, and a network of microcracks is created along the entire length of the well.

Due to the mechanism of directional impact, cracks are created directionally—only in the upper and lateral directions. After the creation of microcracks of DEHDPD removed from the well and to drill first, attach the pump, and the pump is connected DDMWAE. This bundle is lowered into the well.

Then perform microwave, with a frequency of 915 MHz, 2450 MHz or 5800 MHz, and acoustic impact on the formation.

Acoustic impact on the formation is carried out by periodic exposure to the field of elastic vibrations of the ultrasonic range in a constant mode and pulsed acoustic low-frequency impact.

In the constant mode, the effect is carried out by a high-frequency oscillation of the ultrasonic range of 10-30 kHz, and in the pulse mode, the effect is carried out with a frequency of 1-10 Hz, Acoustic influence contributes to the "rocking" of the formation and the breaking of the bonds of oil molecules with the formation rock.

The acoustic effect is performed in two modes: high-frequency (10-30 kHz) and low-frequency (1-10 Hz). The modes alternate sequentially with a frequency of 10 minutes each. The DDMWAE is constantly moving back and forth along the length of the well to process the entire formation located above the well.

The specified microwave and acoustic influence is used to heat the reservoir either in sections of 50 meters (in accordance with the length of the DDMWAE) or in the process of gradual slow movement of the DDMWAE back and forth. After the formation is warmed up to a temperature of 60-80° C., the pump is switched on and oil is extracted from the well via a umbilical cable. Moreover, the microwave effect provides heating of the reservoir to 120-130° C., and the acoustic effect contributes to the rapid penetration of heat waves into the reservoir. the thermoacoustic effect when the temperature reaches 120-130° C., the microwave and acoustic effects stop and only the pump for oil extraction works. After the temperature of the oil fluid decreases, the microwave and acoustic effects on the reservoir are resumed.

When extracting bitumen, a second horizontal well can be drilled above the first one at the reservoir roof, where a solvent is injected in the same way as ES-SAGD or SAS technologies, well known to oil and gas industry specialists, which contributes to a more active flow of bitumen into the lower well.

The technology options discussed above can also be used to extract oil and kerogen from shale deposits.

Figure 13:
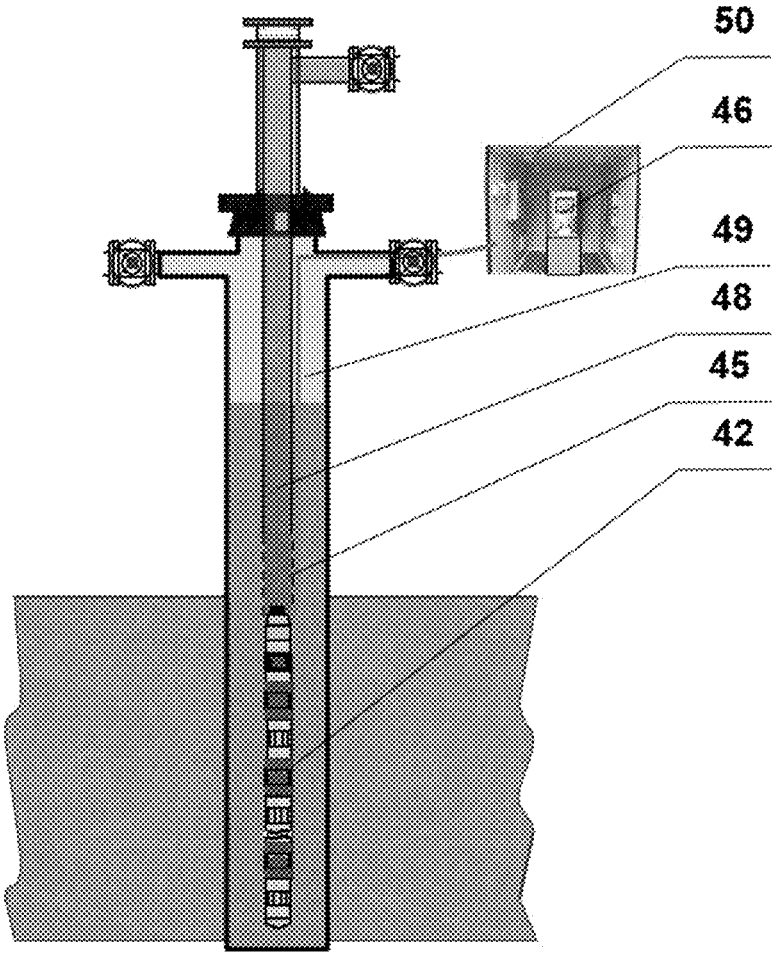
FIG. 13—layout of equipment and equipment for the implementation of the proposed method of extracting heavy oil from a vertical well.

The technology and devices discussed above can be used to extract high-viscosity and heavy oil from vertical wells (FIG. 13). In this case, the pump and DDMWAE are suspended under the pump and compressor pipe (48). Power to the devices is supplied via a multi-core cable (49). the power supply and control Unit (46) is placed in a climate container (50).

Examples of specific applications of the proposed methods and devices do not exclude other applications in the scope of the claim.

REFERENCES

1. Nikolin I. V. Methods of development of heavy oils and natural bitumens. Science—the Foundation for solving technological problems of Russia's development, 2007, no. 2
2. Sidorov I. V. Investigation of high-viscosity oil inflow processes in weakly cemented reservoirs. The dissertation on competition of a scientific degree of candidate of technical Sciences. Tyumen State University, Tyumen, 2015.
3. https://unisteam.com/blog/177-paro-gravitatsionnyj-drenazh-steam-assisted-gravity-drainage-sagd
4. Patent no. RU 2509880, Method for developing deposits of viscous oils and bitumens, 2014.
5. Patent no. RU 2225942, method for developing a bituminous Deposit, 2004.
6. Patent no. RU 2223398, method for extracting viscous oil or bitumen from the reservoir, 2004.
7. Patent no. RU 2206728, Method for extracting high-viscosity oil, 2003.
8. Patent no. RU 2213858, Method for developing deposits of high-viscosity oils or bitumens, 2003.
9. Patent no. RU 2529039, Method of thermoshaft development of high-viscosity oil fields according to a single-horizon scheme, 2014.
10. Patent no. RU 098615, Device for extracting heavy viscous oil, 1997.
11. Patent no. RU 456441, Method for extracting high-viscosity oil by simultaneous injection of steam and liquid extraction from a single horizontal well, 2012.
12. U.S. Pat. No. 4,597,443, Viscous oil recovery method, 1986.
13. U.S. Pat. No. 4,874,043, Method of producing viscous oil from subterranean formations, 1989/14.
14. U.S. Pat. No. 4,535,845, Method for producing viscous hydrocorbons from discrete segments of a subterranean layer, 1985/15.
15. U.S. Pat. No. 4,696,345, Viscous recovery method, 1984.
16. U.S. Pat. No. 3,994,340, Method of recovering viscous petroleum from tar sand, 1976.
17. Patent no. SU 4037658, Method of recovering viscous petroleum from an underground formation, 1977.
18. Yutkin L. A. Electrohydraulic effect and its application in industry. L.: Mashinostroenie, Leningradskoe otd., 1986, 253 p.
19. Kovaleva L., Davletbaev A., Minnigalimov R. Methods for extracting high-viscosity oil and bitumen using high-frequency electromagnetic influence//SPE Moscow, Russia, Oct. 26-28, 2010.

20. Morozov G. A., Morozov O. G. Microwave technologies for oil and gas production complex. Materials of the 12th international conference "microwave equipment and telecommunications technologies. Computer Vision-2002", Sebastopol, 2002. P. 28-31.
21. A New Technique for Heavy Oil Recovery Based on Electromagnetic Heating: Pilot Scale Experimental Validation. Chemical engineering transactions, VOL. 32, 2013.
22. Development of Radio Frequency Heating Technology for Shale Oil Extraction. Open Journal of Applied Sciences, 2012, 2, 66-69.
23. ITU Publications: The Radio Regulations, Edition of 2012.
24. Zobnin N. A. Experience in operating production wells using SAGD technology on the example of OPU-5 of the yaregsky field. Engineering practice #4/2016.
25. Kuznetsov 0. L., Simkin E. M., Chilingar J. Physical bases of vibration and acoustic effects on oil and gas reservoirs, 2001, 260 p.
26. Kuznetsov 0. L., Chirkin I. A., Kuryanov Yu. a. and others. Seismoacoustics of porous and fractured geological media, 2007, 432 p.
27. Revissky Yu. V., Dyblenko V. P. Investigation and justification of the mechanism of oil recovery using physical methods. Moscow, Nedra, 2002, 300 p.
28. Malyukov V. P., Alibekov M. E. Innovative technologies for the intensification of oil production from heterogeneous reservoirs in the fields of ultra-viscous oils of Tatarstan. Vestnik RUDN, Engineering research series, 2015, no. 3

The invention claimed is:

1. A method for extracting highly viscous oil, heavy oil or bitumen from a formation, comprising:

selecting parameters of electro-hydraulic, microwave and plasma exposure individually for each well;

pretreating a horizontal well by an electrohydraulic device with a directional plasma discharger to create microfractures in the formation;

placing on a permanent basis in a horizontal well a downhole device having alternating microwave and acoustic emitters configured for heating the formation, said downhole device is connected to a ground power supply and control through an umbilical cable;

treating the formation by microwaves and acoustic waves using the downhole device while moving the downhole device along the horizontal well back and forth;

extracting oil or bitumen from the formation by means of a pump and the umbilical cable after heating the formation to a temperature of 60-80° C.;

terminating treatment of the formation by microwaves and acoustic waves when the temperature reaches 120-130° C.

2. The method according to claim 1, wherein low-frequency treatment of the horizontal well is carried out at a frequency of 0.01-1.0 Hz, carried out by pulses of 0.5-5.0 kJ.

3. The method according to claim 1, wherein the microwave treatment is carried out at frequencies of 0.915, 2.5 or 5.8 GHz.

4. The method according to claim 1, wherein the acoustic treatment on the formation is carried out by periodically applying a field of elastic vibrations of an ultrasonic range of 10-30 kHz in a constant mode and pulsed acoustic low-frequency exposure with a frequency of 1 to 10 Hz.

5. The method according of claim 1, wherein the formation is treated in sections of 50 meters.

6. The method according to claim 1, wherein an additional horizontal well is drilled above the first one at a roof of the formation and a solvent is injected into the additional horizontal well.

7. The method according to claim 1, wherein the method is implemented for production of highly viscous and/or heavy oil from vertical or horizontal wells, or from shale deposits.

8. A device for extracting highly viscous oil, heavy oil or bitumen from a formation, comprising a ground power supply and control unit located on a surface, and configured for alternating connection through an umbilical cable with an electrohydraulic downhole device with a directional plasma discharger that is configured to create microfractures in the formation only in lateral and upper directions, and with a downhole device that comprises the following modules: a cable head, a guide head, at least one transformer unit, and at least one microwave and at least one acoustic emitter located in series.

9. The device according to claim 8, wherein the plasma discharger is made with a mechanical wire feed drive, wherein a body of the plasma discharger is screwed onto a connecting sleeve, and a support sleeve is attached to a lower part to the body of the discharger, and a wire feeder is installed in the middle part of the sleeve, consisting of a wire spool, a cylinder, a piston connected by means of a rod to a driving pinion drive stage that transmits rotation to a wire feed pinion, and wherein the piston is made with holes for equalizing pressure in an over-piston space with the pressure in a well, and wherein an anode and a cathode are fixed in the support sleeve, the cathode is made with an axial hole for wire passage, and a guide cone with a reflector configured to provide directional radiation is fixed from below to the support sleeve with the help of supports.

10. The device according to claim 8, wherein in a housing of the acoustic emitter and perpendicular to its axis, acoustic transducers are located made as piezoplates, which are placed in the housing perpendicular to each other and there is a support ring between them with an electrical insulating coating to prevent electrical shorting of piezoplates, wherein each piezoplate consists of longitudinally polarized, electrically connected piezoceramic rings with intervening pads located between them, providing high-frequency electrical energy supply to piezoceramic rings, while an emitter housing is made with a wavy surface that provides its transverse pliability, which allows to obtain a single oscillatory circuit that includes the acoustic transducers and the housing.

11. The device according to claim 8, wherein the microwave emitter consists of a waveguide, a magnetron and a heat exchanger, and the waveguide is made with four conically shaped funnels that provide microwave radiation emission in the radial direction, and the heat exchanger is made of a plate type and has a cross section view of a multi-pointed star.

12. The device according to claim 11, wherein the microwave emitter is configured to emit radiation at frequencies of 0.915, 2.5 or 5.8 GHz.

13. The device according to claim 8, wherein the downhole electrohydraulic device is configured to adjust power in the range of 0.5 to 5 kJ.

14. The device according to claim 8, wherein the downhole electrohydraulic device is configured to perform low-frequency exposure from 0.01 to 1.0 Hz.

15. The device according to claim 8, wherein the acoustic emitter is configured to operate in a constant mode at frequencies of 10-30 kHz and in a pulse mode at frequencies of 1-10 Hz.

16. The device according to claim 8, wherein a flexible connection of the downhole device modules of the microwave and acoustic emitters is made in a form of two connecting support sleeves, each of which is attached on one side to the connected modules, and on another side the connecting support sleeves are interconnected by at least two flexible cables, and made with axial holes, where electrical wires are laid, wherein said connection is filled with a silicone filling that is flush with an outside contour of the downhole device.

17. The device according to claim 8, wherein a coiled tubing containing electrical wires is used to connect the power supply and control unit to the downhole device.

18. The device according to claim 8, wherein the downhole device is made with a diameter of 80 mm.

19. The device according to claim 8, wherein temperature sensors are integrated into the guide head and cable head of the downhole device of the microwave and acoustic emitters.

20. The device according to claim 8, wherein the electrohydraulic device with a plasma discharger is made in a form of a block structure, with replaceable blocks of capacitors for regulating a discharge power.

* * * * *